US006162113A

United States Patent [19]

Armstrong

[11] Patent Number: 6,162,113

[45] Date of Patent: Dec. 19, 2000

[54] PROCESS USING IN-SITU ABRASIVE BELT/ PLANER CLEANING SYSTEM

[76] Inventor: Jay T. Armstrong, 2251 White Oak, Wichita, Kans. 67207

[21] Appl. No.: 08/918,078

[22] Filed: Aug. 25, 1997

[51] Int. Cl.[7] ..... B24B 1/00

[52] U.S. Cl. ..... 451/39; 451/56; 451/444

[58] Field of Search ..... 451/38, 39, 56, 451/36, 443, 444; 134/7, 32

[56] References Cited

U.S. PATENT DOCUMENTS

| | | | |
|---|---|---|---|
| 2,568,096 | 9/1951 | Stewart | 451/444 X |
| 3,812,622 | 5/1974 | Parsons | 451/56 X |
| 4,525,955 | 7/1985 | Cothrell et al. | 451/444 X |
| 4,672,985 | 6/1987 | Mohr | 451/444 X |
| 4,720,939 | 1/1988 | Simpson et al. | 451/444 X |
| 4,977,910 | 12/1990 | Miyahara et al. | 451/39 X |
| 5,168,671 | 12/1992 | Kataoka et al. | 451/56 X |
| 5,274,964 | 1/1994 | Simpson et al. | 451/444 X |
| 5,291,693 | 3/1994 | Nguyen | 451/56 X |
| 5,390,450 | 2/1995 | Goenka | 451/39 X |
| 5,484,323 | 1/1996 | Smith | 451/56 X |
| 5,525,093 | 6/1996 | Palmer, Jr. | 451/39 X |
| 5,545,073 | 8/1996 | Kneisel et al. | 451/39 |
| 5,628,672 | 5/1997 | Heesemann | 451/296 X |
| 5,632,150 | 5/1997 | Henzler | 451/39 X |
| 5,727,992 | 3/1998 | Blomqvist et al. | 451/56 |

*Primary Examiner*—Timothy V. Eley
*Attorney, Agent, or Firm*—Nixon Peabody LLP; David S. Resnick; Tim L. Brackett, Jr.

[57] ABSTRACT

Featured is a method and system for cleaning abrasive sanding and/or planing media, for example sandpaper, wide belt sanding belts, planers, grinding wheels or other abrasive surfaces while the media is either in-situ in the sanding, planing, grinding equipment or when removed. Additionally, the cleaning featured method and system can clean the media while the abrasive media is being used as well as when the abrasive media is not being used. In the cleaning method dry ice ($CO_2$, solid carbon dioxide) particles are propelled towards the abrasive surface at a high velocity so the dry ice particles impact on the surface of the abrasive media at a high velocity. Additionally, the dry ice ($CO_2$, solid carbon dioxide) particles are propelled as to impact the abrasive surface at varying angles and locations as necessary to effectively clean the abrasive surface. Further, the dry ice particles are propelled towards the abrasive media when it is in motion, for example rotating, so the dry ice particles impact the abrasive media at different locations of the media. The method and system allow the abrasive media to be cleaned while the abrasive media is being used for its' intended purpose. Thereby reducing equipment downtime usually associated with cleaning and/or changing the abrasive media due to becoming dirty and/or worn.

15 Claims, 2 Drawing Sheets

PROCESS USING IN-SITU ABRASIVE BELT/ PLANER CLEANING SYSTEM

FIELD OF INVENTION

The present invention relates to methods and systems for in-situ cleaning of abrasive sanding or planning media used for sanding, planing, grinding or otherwise abrasively preparing or finishing wood, metal or other surfaces more particularly to methods and systems that use dry ice (i.e., $CO_2$, solid carbon dioxide) particles for in-situ cleaning of the abrasive media surfaces while in use or when the media is not being used.

BACKGROUND OF THE INVENTION

Abrasive sanding or planing devices (also referred to as sandpaper, sanding belts, abrasive planers, or grinding surfaces) are used throughout industry for removing a portion of a material's surface to create a suitable surface finish for the specific requirements. In the woodworking industry, sanding belts are used for removing a portion of the wood surface from a piece of wood as to create a particular finish on the resulting wood surface. An example of such a sanding or abrasive belt is the VFM 36"×75", 30 grit belt. A typical abrasive wide belt is approximately 36"×75"and typically would be placed into an automatic wide belt sanding device. When mounted in the sanding device, the abrasive surface is exposed and the belt is held in place by a series or rollers in the sanding equipment. An example of such an automatic wide belt sanding device is the Cemco Model 2000 wide belt sander.

After the wide belt sanding device is turned on and the abrasive belt is rotating, an operator would place material into a pathway so a surface of the material comes into contact with the abrasive surface of the belt. As the abrasive surface of the belt comes into contact with the material being sanded, a portion of the wood surface ie removed by the abrasive surface.

As a result of this sanding operation, the abrasive sanding belt begins to "load up" with pieces of the material being sanded. In wood products this "loading up" may comprise pieces of wood, sap, glue and/or burnt wood particles. As the abrasive belt "loads up", the amount of sanding/grinding/planing decreases and the quality of the materials being processed is effected. The abrasive surface of the belt will continue to sand a surface until it becomes loaded to the extent where it ceases to provide the necessary sanding characteristics. At this time, the operator typically removes the sanding belt and replaces it with a new one, permanently disposing of the used, loaded up, abrasive sanding belt.

Prior attempts to clean abrasive sanding/planing media have involved the use of solvents, water or a gummy type solutions that require the abrasive belt to be first removed from the sanding device so the solution can be applied thereafter to the surface of the belt. This cleaning operation, however, yields an abrasive belt that is only partially cleaned. Because the abrasive belt most often has a paper type backing, the belt also tends to stretch after exposure to these cleaning solutions and thus no longer fits correctly onto the sanding equipment. These methods of cleaning greatly reduce the life of the belt.

In addition to the foregoing shortcomings or problems with prior art cleaning methods, removing the belts from the equipment or device reduces the production capacity of the machine at a rate relative to the amount of time required to shut the machine down and remove, replace and reset the belt on the machine. Removal and re-installation of the belts also involves re-tensioning of the belt on the equipment to the previous tension(s) so the material being processed through the equipment having a "cleaned belt" will have the same finish as the previous material process before cleaning the abrasive belt. Because the belts tend to stretch after application of the cleaning solution(s), however, the "cleaned" belts do not tighten correctly. Also, and as a result of these prior art cleaning methods, the "cleaned" abrasive belts may fall apart when the equipment is turned on and operated.

In sum, a long outstanding and major problem within the woodworking and metalworking industries in the area of surface preparation and/or finishing involves the capability to clean the abrasive surface of the sanding, grinding or planing equipment. Prior attempts have not solved this long standing problem with cleaning such abrasive sanding, planing or grinding surfaces.

DEFINITIONS

The present invention is most clearly understood with reference to the following definitions:

Dry ice shall be understood to mean solid carbon dioxide or solid $CO_2$.

SUMMARY OF THE INVENTION

The present invention features methods and systems/apparatuses for in-situ cleaning of abrasive sanding, planning or grinding surfaces involving the use of dry ice particles to clean the surface without causing any damage to the abrasive sanding, planing or grinding surface or any damage to the belt's backing (e.g., paper type backing). In addition, a process and system/apparatus is provided by which the abrasive sanding, grinding or planning surface can be cleaned in-situ when mounted to the applications equipment (e.g., wide belt sanding device). In particular, when the equipment is in operation and processing material to be sanded, planned or ground. Such cleaning can be performed without affecting the operation of the equipment.

Because of this on-line and in-situ capability for cleaning an abrasive surface, the quality of the finished product or material is drastically increased. Additionally, the cleaning process and system/apparatus of the present invention increases the useable life of the typical sanding, planning and grinding belt, thereby reducing the a user's purchases of new abrasive belts. Moreover, in-situ cleaning according to the method of the present invention results in the realization of significant production savings by simply not having to change, for example, an abrasive belt as often as if there was no on-line or in-situ cleaning process or system.

More particularly, the method for cleaning an abrasive surface such as a sanding, planning or grinding surface includes accelerating dry ice particles to a high velocity and directing the high velocity dry ice particles at a surface to be cleaned so the high velocity dry ice particles impact the surface thereby causing the contaminants therein to be removed. The high velocity dry ice particles also are directed at varying angles and locations so as to clean the entire abrasive surface. Such a method further includes capturing or collecting the removed contaminants from the abrasive surface while cleaning the surface. For example, a suction can be applied in the area where the dry ice particles are being applied to the surface so the removed contaminants can be capture or collected thereby.

Other aspects and embodiments of the invention are discussed below.

BRIEF DESCRIPTION OF THE DRAWING

For a fuller understanding of the nature and desired objects of the present invention, reference is made to the following detailed description taken in conjunction with the accompanying drawing figures wherein like reference character denote corresponding parts throughout the several views and wherein.

DESCRIPTION OF THE PREFERRED EMBODIMENT

Figure 1:
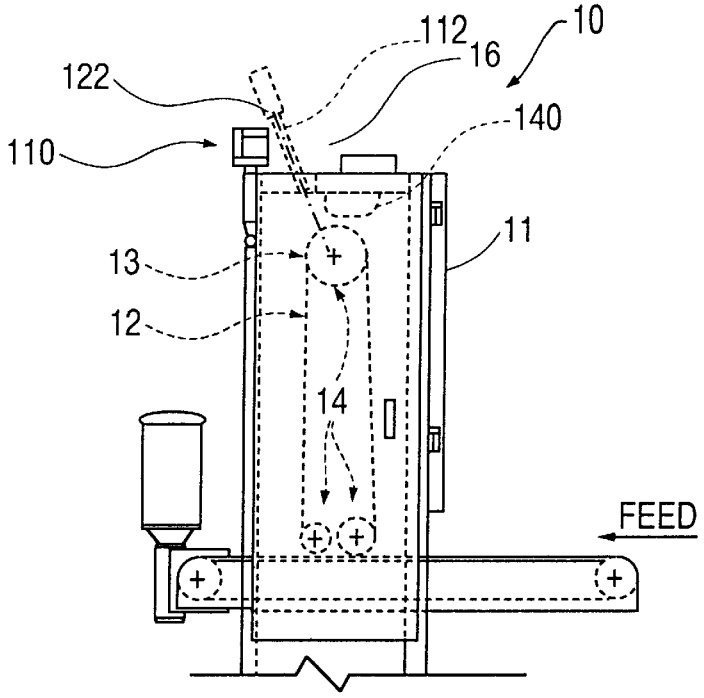
FIG. 1 is a side view of the abrasive belt sanding apparatus of an abrasive belt sanding apparatus including the cleaning system of the present invention.
Figure 2:
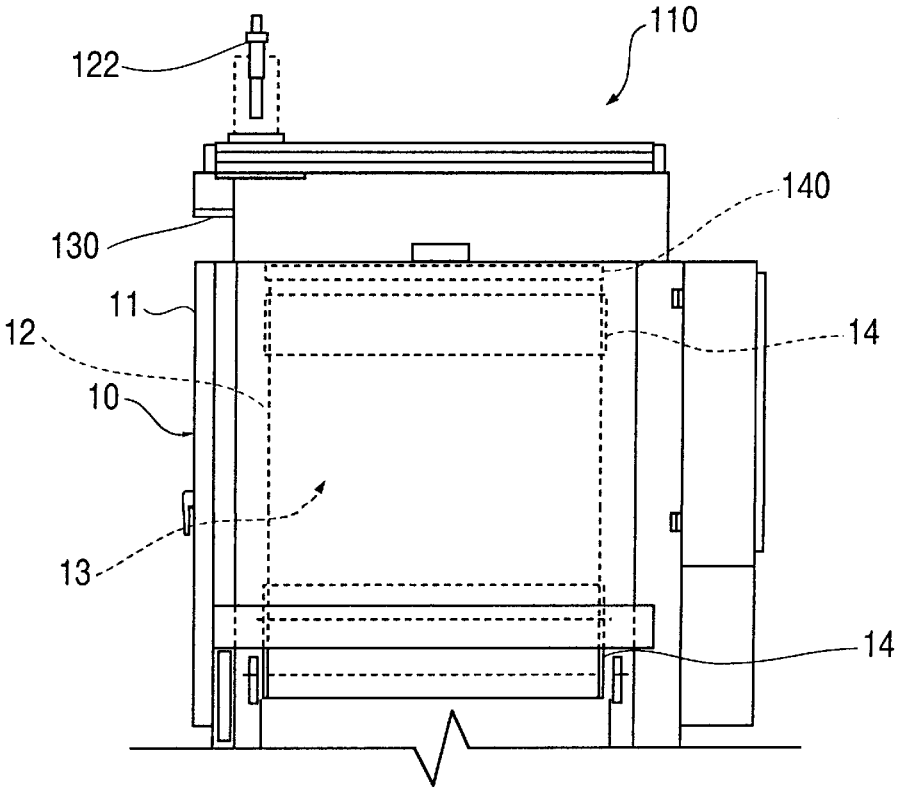
FIG. 2 is a front view of the abrasive belt sanding apparatus of FIG. 1 in which the x-rail motion control device of the cleaning system is partially elevated out of position for clarity.
Figure 3:
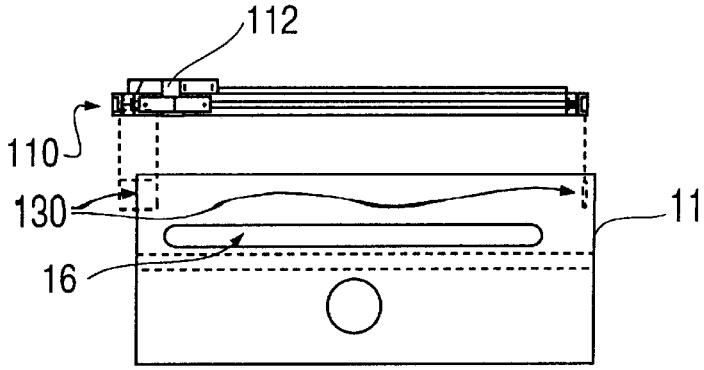
FIG. 3 is a top view of the abrasive belt sanding apparatus of FIG. 1, with the x-rail control device laterally disposed out of position.

Referring now to the various figures of the drawing wherein like reference characters refer to like parts, there is shown in FIGS. 1–3, side, front and top views respectively of an abrasive belt sanding apparatus 10 including a dry ice cleaning system of the present invention. Such an abrasive belt sanding apparatus 10 includes an abrasive belt 12 and a plurality of tension rollers 14 on which is mounted the abrasive belt 12. The tension rollers 14 also rotate the abrasive belt 12 within the sanding apparatus. Typically, material or product is feed or presented to the abrasive belt 12 in a feed direction to prepare or finish a surface of this product or material. As hereinabove described, this preparation or finishing process results in the abrasive surface of the belt 12 becoming "loaded up" with for example, pieces of wood, sap, glue and/or burnt wood particles, and these surface contaminants degrade the abrasive quality of the belt.

The abrasive belt sanding apparatus 10 includes a dry ice cleaning system having an x-rail motion control device 110 and a dry ice dispensing sub-system. The dry ice dispensing sub-system includes a dispensing nozzle 122 or other device that can directional control the dispensing of high velocity solid dry ice particles therefrom, a dry ice blaster (not shown) and hoses (not shown) interconnecting the dry ice blaster to the dispensing nozzle. The dry ice dispensing sub-system also includes a dry ice storage means (not shown) and/or a dry ice grinding/ shaving means (not shown) that supplies the dry ice particles for blast cleaning. In an exemplary embodiment, the dry ice storage means, dry ice grinding/ shaving means, and the dry ice particle blaster are located remote from the abrasive belt sanding apparatus 10 and more particularly remote from the abrasive surface 13 to be cleaned.

There is mounted to the top surface of the housing 11 for the abrasive belt sanding apparatus 10 the x-rail motion control device 110 to which is mounted the dry ice dispensing nozzle 122. As more clearly illustrated in FIG. 1, a portion of the dry ice dispensing nozzle 122 passes through an opening 16 in the housing top surface so the exit port of the nozzle is disposed within the abrasive belt sanding apparatus housing 11 and so the dry ice particle exiting the dispensing nozzle 122 are generally directed towards the abrasive belt 12. As shown in FIG. 3, this opening 16 is in the form of a slot in the housing top surface that extends widthwise whereby the dispensing nozzle 122 can traverse across the x-axis of the abrasive belt 12.

The solid dry ice particles are propelled from the dispensing nozzle 122 at a high velocity so as to cause the dry ice particles to impact the abrasive belt surface 13. More particularly, and as shown in FIG. 1, the dispensing nozzle 122 is orientated so the dry ice particles impact a portion of the abrasive belt 12 that is contact with one of the tension rollers 14 of the abrasive belt sanding apparatus 10

The solid dry ice particles also are directed by the dispensing nozzle 122 so as to impact the abrasive surface in such a way as to remove any contaminants intrained in the abrasive belt surface 13 and thus resulting in a cleaned or renewed abrasive surface. In particular, the dry ice particles are propelled so as to impact the abrasive belt surface 13 at varying angles and locations as necessary to effectively clean the abrasive surface. The angle of impact of the dry ice particles and the abrasive belt surface 13, or the angle between the dispensing nozzle 122 and the one of the tension rollers 14, can be adjusted or varied by means of a device 130 that acts on the x-rail motion control device 110. Thus, the angle of impact and the cleaning ability of the cleaning apparatus can be optimized.

In the illustrated embodiment, the location of impact is automatically varied by means of the x-rail motion control device 110 which automatically moves the dispensing nozzle 122 across the x-axis (i.e., width) of the abrasive belt surface 13 at a fixed or variable distance. The dry ice particles also are directed towards the abrasive belt 12 either when the belt is being rotated by the tension rollers 14 or the belt is stationary. If the abrasive belt 12 is being rotated, then the abrasive surface can be cleaned while the abrasive belt is in use or being used for its intended purposes. Thereby reducing the downtime of the abrasive belt sanding apparatus 10 as compared to prior art techniques involving the cleaning or replacement of the abrasive belt, when it becomes dirty and/ or worn. Additionally, as the abrasive belt 12 is being rotated, the dry ice particles impact the abrasive belt surface 13 at different locations.

Initial test results indicate that a typical abrasive sanding, planing or grinding belt may be cleaned and reused a minimum of at least two (2) times during its usable life, meaning that a user may reduce new abrasive belt purchases by a factor of at least two (2). In addition, significant production savings are realized by not having to change the abrasive belt as often when it is cleaned in-situ with the dry ice particles.

Alternatively, the dispensing nozzle 122 can comprise a hand-held dispensing device where a user manually controls or directs the dry ice particles propelled from the dispensing nozzle towards the belt abrasive surface 13 while the belt is moving, stationary or after the belt is removed from the abrasive belt sanding apparatus 10. The user also would manually vary the angle and location of impact so the impacting dry ice effectively cleans the abrasive surface.

The dry ice cleaning system of the present invention can further include a vacuum device 140 or apparatus that is positioned so a suction is developed or applied to the area in which the dry ice particles are being applied to the abrasive belt surface 13 during the cleaning process. The suction or vacuum device 140 can be used to capture, contain and/or collect the surface contaminants that had been removed from the abrasive belt surface 13 by means of the dry ice particle cleaning action.

Figure 4A:
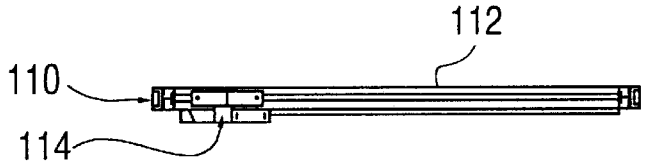
FIGS. 4A–C are top, side and end views respectively of the X-rail motion control device of FIGS. 1–3.
Figure 4B:
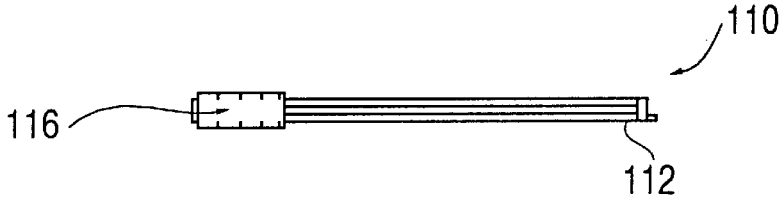
Figure 4C:
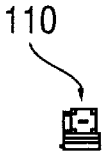

Referring now to FIGS. 4A–C, there is shown top, side and end views respectively of an x-rail motion control device 110 for the dry ice cleaning system according to the present invention. The x-rail motion control device 110 includes a rail 112, a mounting device 114 and moving member 116, to which the mounting device is secured, that moves back and forth along the length of the rail. In this way, the dry ice dispensing nozzle 122, when it is connected to the mounting device 114, can be manually or automatically moved across the x-axis of the surface to be cleaned, for example the abrasive belt surface 13 (see FIG. 1).

Although the foregoing describes the motion control device has causing motion across the x-axis of the surface to be cleaned, it is within the scope of the present invention for such a motion control device to be positioned or configured so the dispensing nozzle 122 traverses across the y-axis of the surface to be cleaned. Alternatively, the motion control device also can be configured so the dispensing nozzle 122 can move along two axes, both the x-axis and y-axis. Also, although the above-described dry ice cleaning system and dry ice cleaning method or process has been described with reference to an abrasive belt sanding apparatus, it is within the scope of the present invention to adapt the method and apparatus so as to be capable of cleaning any abrasive sanding, planing or grinding media including for example, sandpaper, sanding belts, planers and grinding wheels.

Although a preferred embodiment of the invention has been described using specific terms, such description is for illustrative purposes only, and it is to be understood that changes and variations may be made without departing from the spirit or scope of the following claims.

What is claimed is:

1. A process for the in-situ cleaning of an abrasive surface of a belt for performing one of sanding, planing and grinding, said belt being mounted for rotation within a housing of an apparatus for performing one of abrasive sanding, planing and grinding, said in-situ cleaning process comprising the steps of:

directing dry ice particles towards the abrasive surface of said belt while said belt is mounted within the housing of said apparatus; and impacting the abrasive surface of said belt while said belt is mounted within the housing of said apparatus with the dry ice particles so as to remove material generated during operation of said device and being retained on the abrasive surface of said belt so as to not materially effect the abrasive surface of said belt.

2. The in-situ abrasive surface cleaning process of claim 1, wherein said steps of directing and impacting are performed concurrently with at least one of sanding, planing and grinding by said apparatus.

3. The in-situ abrasive surface cleaning process of claim 2, wherein said steps of directing and impacting are performed as material is being processed in said apparatus.

4. The in-situ abrasive surface cleaning process of claim 1, further comprising the step of applying a suctional force so as to suctionally collect the material being removed by said impacting of the abrasive surface.

5. The in-situ abrasive surface cleaning process of claim 4, wherein said steps of directing and impacting are performed concurrently with at least one of sanding, planing and grinding by said apparatus.

6. The in-situ abrasive surface cleaning process of claim 5, wherein said steps of directing, impacting and applying are performed as material is being processed in said apparatus.

7. The in-situ abrasive surface cleaning process of claim 1 wherein said step of directing includes selectively directing the dry ice particles so the dry ice particles traverse the abrasive surface in at least one direction.

8. The in-situ abrasive surface cleaning process of claim 7, wherein said step of selectively directing includes traversing the abrasive surface in two directions.

9. The in-situ abrasive surface cleaning process of claim 7, wherein said step of selectively directing includes directing the dry ice particles to a portion of the abrasive surface and sequentially re-directing the dry-ice particles towards successive portions of the abrasive surface.

10. The in-situ abrasive surface cleaning process of claim 1, further comprising providing a nozzle to directionally dispense the dry ice particles and wherein said directing includes positioning the nozzle so as to direct the dry-ice particles exiting the nozzle towards the abrasive surface.

11. The in-situ abrasive surface cleaning process of claim 10, wherein said directing includes selectively re-positioning the nozzle so the nozzle traverses the abrasive surface in at least one direction.

12. The in-situ abrasive surface cleaning process of claim 11, wherein the abrasive surface is in motion and wherein said selectively re-positioning the nozzle is done sequentially so the nozzle traverses the entire surface of the abrasive surface.

13. The in-situ abrasive surface cleaning process of claim 11, wherein said selectively re-positioning the nozzle is performed automatically.

14. The in-situ abrasive surface cleaning process of claim 11, wherein said providing further includes providing a means for moving the nozzle with respect to the abrasive surface in at least one direction.

15. The in-situ abrasive surface cleaning process of claim 1, wherein the abrasive surface includes a front side and a backside and wherein said impacting includes supporting the backside while impacting a corresponding front side with dry ice particles.

* * * * *